United States Patent [19]

Draizen et al.

[11] 4,119,278

[45] Oct. 10, 1978

[54] CONTINUOUS LONG ENDS WIRE SPOOLING APPARATUS

[75] Inventors: Seymour Draizen, Old Bridge; Konrad C. Schillebeeckx, Colts Neck, both of N.J.

[73] Assignee: Syncro Machine Company, Perth Amboy, N.J.

[21] Appl. No.: 774,674

[22] Filed: Mar. 7, 1977

[51] Int. Cl.[2] ..... B65H 54/02

[52] U.S. Cl. ..... 242/25 A

[58] Field of Search ..... 242/25 A, 25 R, 18 A

[56] References Cited

U.S. PATENT DOCUMENTS

| | | | |
|---|---|---|---|
| 3,596,844 | 8/1971 | Engmann | 242/25 A |
| 3,620,482 | 11/1971 | Bravin | 242/25 A |

FOREIGN PATENT DOCUMENTS

| | | | |
|---|---|---|---|
| 2,323,747 | 11/1974 | Fed. Rep. of Germany | 242/25 A |

*Primary Examiner*—Stanley N. Gilreath
*Attorney, Agent, or Firm*—Darby & Darby

[57] ABSTRACT

An apparatus for providing "long ends" on reels of wire is incorporated in a continuous wire spooler. In an illustrative embodiment, continuous spooling is achieved by alternately filling each of a pair of reels while the other, previously filled, reel is removed and replaced with an empty one. The reels are filled with the aid of a wire distributor which is periodically commuted between the two reel positions in order to guide wire from a source to the reel being filled. At each of the reel positions there is provided a reel-receiving arbor including a concentric dummy reel positioned to be axially aligned with and adjacent to a reel which is mounted on the arbor. A chain in a closed loop is movable in a plane perpendicular to the arbor. A portion of the loop is substantially aligned with a corresponding part of the perimeter of the aft flange of the dummy reel. As the chain moves around its track, a guide pin mounted on the chain intercepts wire positioned over the empty reel and moves the wire over the aft flange of the reel and the fore flange of the dummy. Thereafter, a cam striker mounted on the chain closes a relay as it moves along the chain path. The relay causes a throw pin, mounted proximate the arbor to engage the wire and move it into position for snagging. A snagger mounted to a rotatable snagger disc constituting the aft flange of the dummy reel engages the wire for winding onto the dummy reel. Thereafter a second guide pin mounted on the chain intercepts the wire from the distributor and moves it back over the fore flange of the dummy reel and the aft flange of the empty reel. The wire, which is to be spooled on the empty reel, is guided by a shield ring to mate with the empty reel in such a manner as to assure proper engagement therewith. Upon such engagement, a second cam striker on the chain closes a relay, thereby stopping the movement of the chain.

12 Claims, 2 Drawing Figures

CONTINUOUS LONG ENDS WIRE SPOOLING APPARATUS

BACKGROUND OF THE INVENTION

The present invention relates to the continuous spooling of wire, and more specifically to continuous spooling wherein there is produced a relatively long length of wire (a "long end") at the starting or inside end of the wire on the reel, which length of wire is accessible externally of the reel.

It is conventional for wire to be taken from the drawing machine and continuously spooled on a pair of associated reels. See for example U.S. Pat. Nos. 2,763,443; 3,086,721 and 3,368,765, all of which are owned by the assignee of this application. As will be appreciated, it is undesirable that the wire-drawing machine be shut down to transfer the wire feed from a filled reel to an empty one. Therefore, means have been devised to automatically shift the wire from a full reel to an empty one while the wire-drawing machine remains in operation. The reels may be mounted side-by-side, on parallel axes (as in the above referenced patents), or in other orientations.

In a variety of applications of spooled wire, it is frequently desirable that both the starting (or inside) and the terminal (or outer) ends of the wire of the full reel be readily accessible prior to unwinding. This simplifies "follow on" processes, since ends can then be joined to assure continuous operation. For this purpose it is preferred that the inside wire end have a relatively long end so as to facilitate such a process.

Accordingly, one object of the present invention is to provide an apparatus which produces a relatively long end of wire at the starting (inside) end of the wire on the barrel of the reel.

It is another object of the present invention to provide a continuous spooler apparatus for winding wire or cable continuously onto reels without the need to stop the winding machine.

It is yet another object of the present invention to provide an apparatus for transferring the supply of wire from a full reel to an empty reel in a continuous wire spooling machine without accumulating wire in a corner of a full reel.

SUMMARY OF THE INVENTION

These and other objects are achieved in a continuous wire spooler of the type described by providing a mechanism which places the "long end" into a dummy reel mounted coaxially with and adjacent to a winding reel on an arbor. In an illustrative embodiment, continuous spooling is achieved by alternately filling each of a pair of reels while the other, previously filled, reel is removed and replaced with the empty one. The reels are filled with the aid of a wire distributor which is periodically commuted between the two reel positions in order to guide wire from a source to the reel being filled. At each of the reel positions there is provided a reel-receiving arbor and a concentric dummy reel. A chain in a closed loop is movable in a plane perpendicular to the arbor. A portion of the loop is substantially aligned with a corresponding part of the perimeter of the aft flange of the dummy reel. As the chain moves around its track, a guide pin mounted on the chain intercepts wire positioned over the empty reel and moves the wire over the aft flange of the winding reel and the fore flange of the dummy. Thereafter a cam striker mounted on the chain closes a relay as it moves along the chain path. The relay causes a throw pin mounted proximate the arbor to engage the wire and move it into position for snagging. A snagger mounted to a rotatable snagger disc constituting the aft flange of the dummy reel engages the wire for winding onto the dummy reel. Thereafter a second guide pin mounted on the chain intercepts the wire from the distributor and moves it back over the fore flange of the dummy reel and the aft flange of the empty reel. The wire, which is to be spooled on the empty reel, is guided by a shield ring to mate with the empty reel in such a manner as to assure proper engagement therewith. Upon such engagement, a second cam striker on the chain closes a relay, thereby stopping the movement of the chain. In the described arrangement, the length of the long ends is readily varied by repositioning the pins and cams along the chain.

BRIEF DESCRIPTION OF THE DRAWINGS

In the description of the preferred embodiment reference is made to the appended drawings in which.

Figure 1:
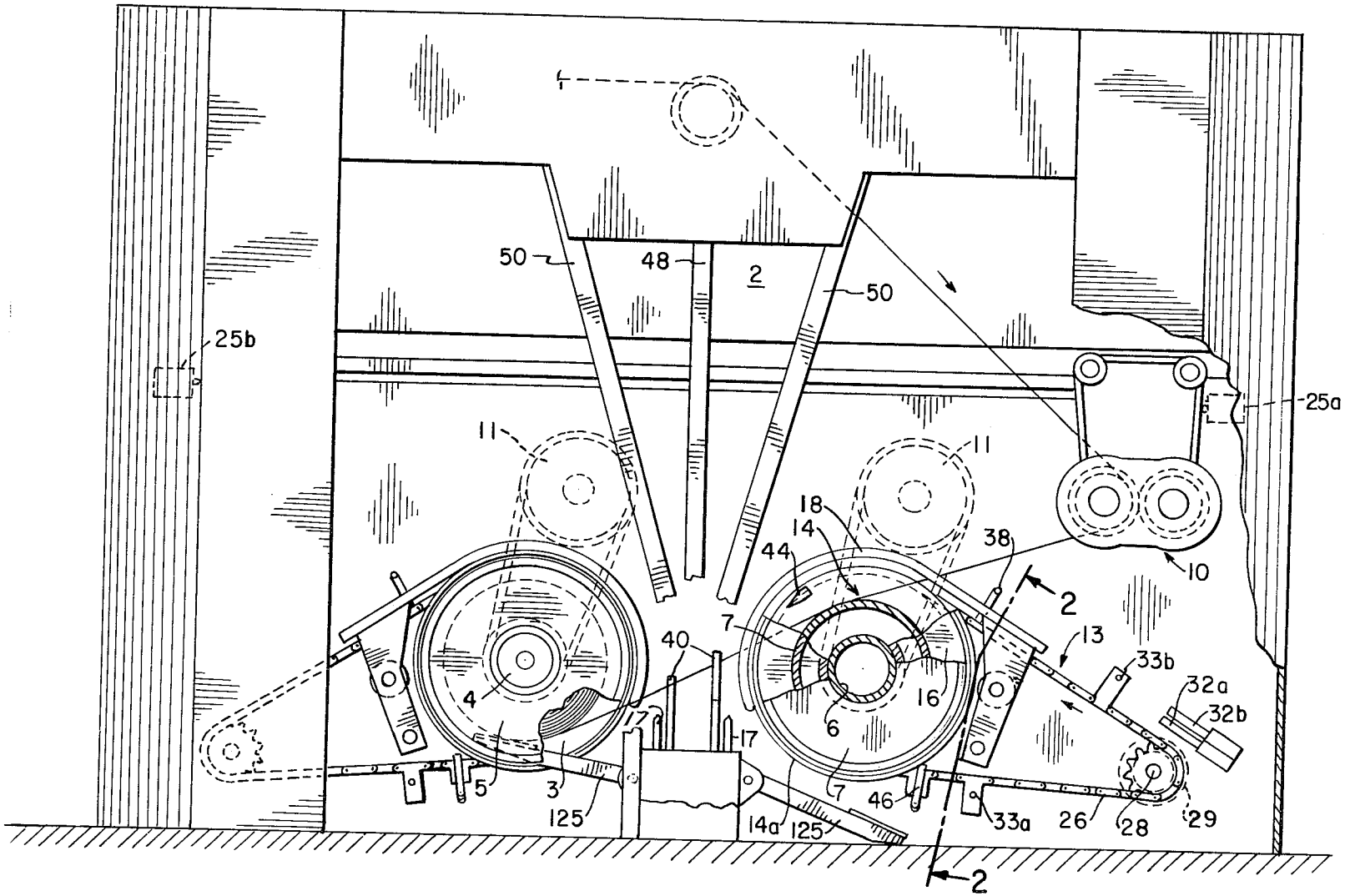
FIG. 1 is a front elevation view in partial cross-section of a complete spooler of the type herein disclosed.

DESCRIPTION OF THE PREFERRED EMBODIMENT:

FIG. 1 illustrates a dual spooler winding machine having a housing 2 in which are rotatably mounted, in parallel, left arbor 4 and right arbor 6. On left arbor 4 is a full winding reel 5 of wire 3, while an empty winding reel 7 is shown on the right arbor 6. In the drawings the arbors are illustratively shown in side-by-side relationship, but it should be understood that other arrangements, including coaxially mounted reels, may be utilized.

Distributor 10, transversely movable in housing 2, distributes wire axially (in fore and aft directions) on each winding reel, as well as transversely between the reels 5 and 7. The wire passes through the distributor 10 onto the rotating reel which is driven by a motor in housing 2. As the reel winds, the distributor reciprocates between the fore and aft flanges of the reel at a uniform rate so that the wire is wound evenly on the reel. When the reel is nearly full, distributor 10 shifts wire 3 to the alternate winding reel as shown in FIG. 1 to terminate winding on the full reel and begin winding on the empty reel.

As thus far described, the elements and their operations are conventional and do not embody inventive aspects herein claimed. Those skilled in the art are referred to literature in the art, including the above-listed patents, for further details of construction suitable for use in this embodiment as thus far described.

While distributor 10 moves from reel 5 into position over reel 7, it continues to reciprocate fore and aft along the axis of the reel so that wire 3 continues winding evenly onto reel 5. Movement of distributor 10 to the extreme rightward position shown in FIG. 1 trips a microswitch 25*a*, or the like, mounted on housing 2 and activates a guiding mechanism 13 for reel 7. Inasmuch as the distributor continues to reciprocate during the entire period of transfer, there is no wire buildup in the reel corners.

In brief, the function of chain mechanism 13 is to move wire 3 from a position over winding reel 7 into position for winding on a dummy reel 14 for the time or length to produce the initial "long end" of wire on reel 7. After this dummy reel winding, the chain mechanism 13 returns wire 3 from dummy reel 14 into position over the empty winding reel 7 for winding thereon. The winding on dummy reel 14 to create the long end of wire on the starting (inside) end of reel 7 is hereinafter described in detail.

Referring now to guiding mechanism 13 for reel 7, it being understood that a same mechanism in opposite arrangement is used for reel 5, dummy reel 14 is rotatably mounted on arbor 6. Dummy reel 14 is provided with a belled flange 14*a* at its forward end and a snagger disc 14*b* at its aft end.

Figure 2:
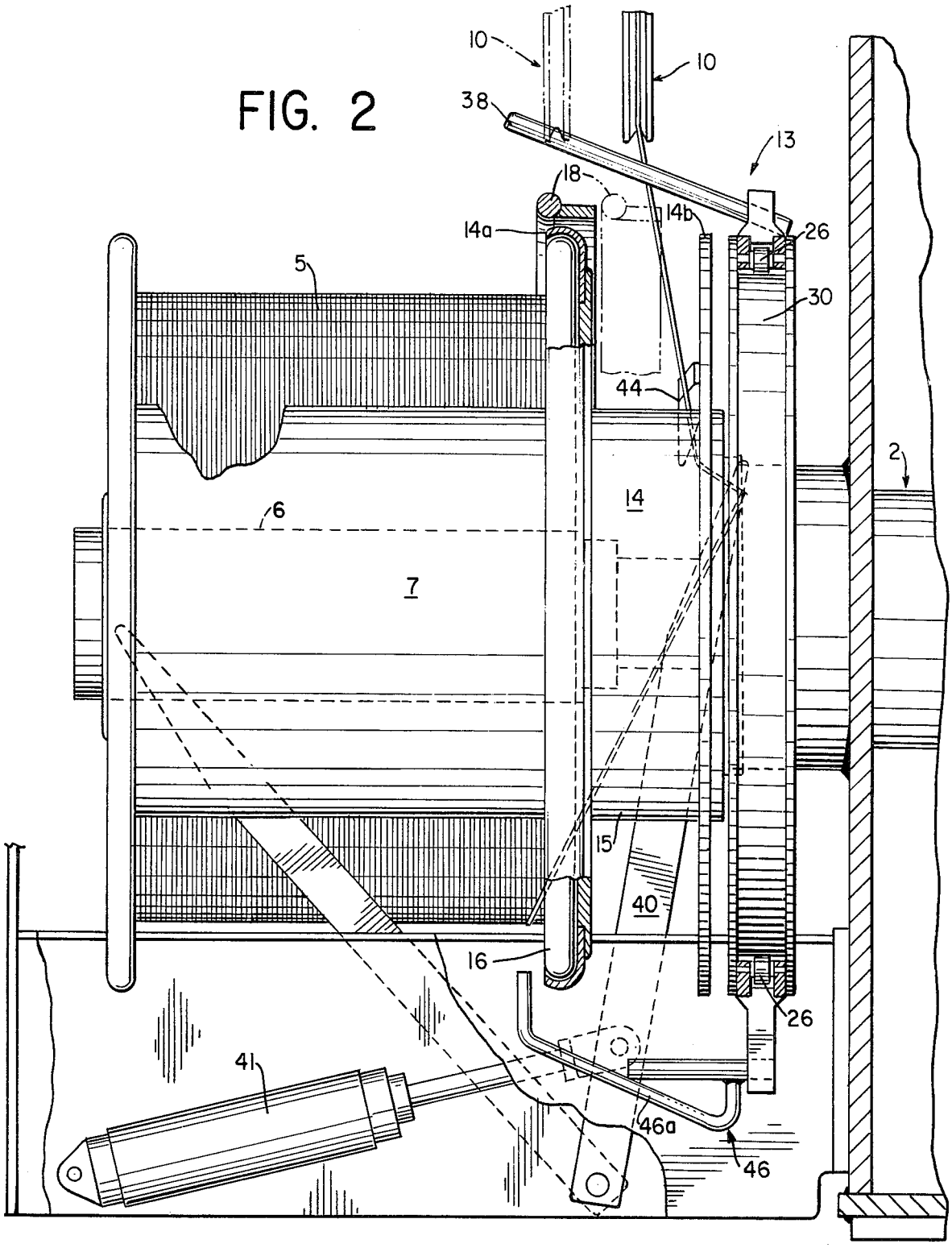
FIG. 2 is a side elevation view in partial cross-section taken along line 2—2 of FIG. 1, showing the winding reel, dummy reel and wire distributing and guide means embodying the invention.

Positioned over the forward flange of dummy reel 14 is a shield ring 18, mounted to housing 2 and adapted for movement parallel to arbor 6. The shield ring is shaped as shown in FIG. 2, and is positioned radially outward of the aft flange 16 and fore flange 14*a*. The shield ring 18 extends around a part of the circumference of the flanges.

Adjacent the aft end of dummy reel 14 is a chain guide 30 which may simply comprise a trough extending around part of the circumference of snagger disc 14*b*. Chain 26 is driven in guide 30 along a continuous loop in a plane perpendicular to the arbor by a chain sprocket 28 which is rotated by a chain motor 29. Chain 26 is driven in a counterclockwise direction for the guiding mechanism 13 associated with right arbor 6, which also moves counterclockwise.

A set of two low voltage switches 32*a* and 32*b* is mounted in fixed position on the housing 2 of the spooler proximate chain 26. First and second cam strikers 33*a* and 33*b* are removably mounted on and move with chain 26 so as to pass over and momentarily contact (close) respectively the low voltage switches 32*a* and 32*b* during each revolution of chain 26 through the loop. The chain moves at a predetermined rate, and the cams are selectively mountable at any point along the chain. Consequently, the switches 32*a* and 32*b* may be activated at known intervals in accordance with placement of the cams along the chain.

As noted above, the chain motor is activated when the distributor 10 reaches an extreme right position and trips the microswitch 25*a*. The microswitch activates a hydraulic, pneumatic, or other, moving means causing the shield ring 18 to move towards housing 2 until it projects over the barrel 15 of dummy reel 14 (shown in phantom in FIG. 2). The microswitch causes the chain motor to move the chain 26. Mounted to and moving with chain 26 is dummy reel entry pin 38 which projects at an angle over the dummy reel 14 and shield ring 18. When entry pin 38 is moved into position directly above the barrel 15 of reel 14, both the pin and the arbor 6 lie in a vertical plane. As may be seen in FIG. 2, lines passing through the arbor 6 and the pin 38 would form an acute angle originating behind the housing and opening towards the arbor. Thus entry pin 38 may be positioned so that as wire 3 is guided to a position next to aft flange 16 of winding reel 7, pin 38 intercepts the wire and guides it further aft to a position adjacent snagger disc 14*b* of dummy reel 14.

The initial advance of chain 26 causes this action in the following manner. The entry pin 38 intercepts wire 3 to carry it over a portion of its movement around the continuous loop. Because the front edge of pin 38 is positioned radially outward of the inner (aft) flange 16 of the empty reel 7 and radially outward of the shield ring 18, the wire 3 will slide along the moving dummy reel entry pin 38 to project over the dummy barrel 15. As the dummy reel entry pin 38 continues along the loop, the wire 3 will ultimately be laid upon the dummy barrel 15, after which the pin 38 will disengage the wire 3 by passing beneath the dummy barrel 15.

At this time cam striker 33*a* will have advanced to the point where it contacts the low voltage switch 32*a* which activates a transfer throw pin 40 operated by pneumatic cylinder 41. A transfer pin 40 is pivotally mounted to the base of spooler housing 2 and is positioned adjacent one of the dummy reels. The pin 40 adjacent dummy reel 14 is positioned such that on activation throw pin 40 engages and pushes aft the wire 3 (which is still feeding from the distributor 10 to reel 5 on the left arbor 4) at a time when the wire 3 is contiguous with or near the dummy barrel 15 and adjacent snagger disc 14*b*. The positions of transfer pins 40 are shown in FIG. 2, where the lefthand (in FIG. 1) transfer pin is shown in the inactive position and the righthand (in FIG. 1) transfer pin is shown in the active position. Prior to engaging wire 3, the free end of pin 40 is near the plane of the fore flanges of the winding reels (inactive position). After engagement, the free end is near housing 2 (active position) and remains there. With the wire adjacent the snagger disc, a snagger 44 mounted to the snagger disc 14*b* intercepts the wire. Snagger 4 engages wire 3 to move it over cutter 17 which cuts the wire and thereby terminates winding on the reel 5 on the left arbor 4. Reel 5 is then brought to a stop and the throw pin 40 is returned to its inactive position.

A flapper 125 is pivotally mounted adjacent each of the throw pins 40 and is normally in the down position. When the distributor 10 actuates switch 25*a*, the flapper 125 adjacent the throw pin for the left arbor pivots and positions against the filled reel to prevent the loose wire end from unraveling while the full reel decelerates. This is achieved by means of a conventional solenoid and mechanical linkage (not shown). After reel 5 comes to a stop, the lefthand flapper 125 is reset to its down position (this could be done manually or by means of a reset button which is not shown).

Snagger disc 14*b* and snagger 44 continue to rotate and thereby wind the wire 3 onto the dummy barrel 15. The length of wire thus wound on the dummy barrel is the "long end" of wire at the starting (inside) of the wire to be wound on winding reel 5.

Next a dummy exit pin 46 mounted to chain 26 passes along the closed loop of the chain to intercept once again the wire 3 between the distributor 10 and the dummy barrel 15. The exit pin 46 may be a rod having a transverse portion 46*a* similar to the dummy entry guide pin 38, but sloping in the opposite direction (having a radial component, so that lines passing axially through the transverse portion 46*a* and the right arbor 6 intersect to form an acute angle opening toward the housing 2). Consequently, once the dummy exit pin 46 intercepts the wire 3 passing between the distributor 10 and the dummy core 15, the wire slides along the exit pin 46 over the circular dummy shield ring 18 fitted over the inner flange of the spool 7 mounted on the right arbor 6. When the wire reaches the edge of the exit guide pin 46 and the end of the shield ring, it is properly positioned onto the barrel of the empty spool 7, which is rotating counterclockwise with the arbor 6. A second cam striker 33*b* mounted to the chain 26 then contacts the low voltage switch 32b to deactivate the chain motor 27. The switch 32b also causes shield ring 18 to return to its initial position. While the empty reel is being filled a curtain 48 comes down between the guides 50 intermediate the arbors. This curtain may be inserted manually by the operator and withdrawn after the full reel is replaced with an empty one. Alternatively, the curtain may be actuated and automatically by conventional means (not shown). The operator removes the full roll through a conventional reel ejector (not shown). He then mounts an empty reel on the left arbor for winding in a manner similar to that described for a spool mounted to the right arbor 6. This is begun by resuming rotation of arbor 4, at which time curtain 48 is withdrawn.

Consequently, this arrangement provides for the continuous spooling of wire onto spool and provides for long ends. This provides the tremendous advantage of continuous operation. Further, the operator may disengage the filled or completely wound spool from the machine without exposure to a rotating spool or arbor, thereby eliminating a hazard.

To those skilled in the art it will be apparent that the invention is capable of taking various useful forms, and it is preferred, therefore, that this disclosure be taken in an illustrative sense, and that the scope of protection afforded be determined by the appended claims.

What is claimed is:

1. Wire guiding apparatus for a spooler having a housing, an initially empty winding reel to receive wire extending along a path adjacent both said winding reel and a dummy reel adapted to receive an initial quantity of wire defining a long end, a fore flange between said dummy reel and said winding reel, an aft flange on said dummy reel opposite said fore flange, said apparatus comprising:

a conveyor adapted for movement at selected times in a path proximate said dummy reel;

a wire entry device mounted to said conveyor and being adapted to intercept said wire and to move said wire onto said dummy reel; and a wire exit device mounted to said conveyor means and adapted to intercept wire being wound onto said dummy reel and to move said wire onto said winding reel for winding thereon.

2. Apparatus according to claim 1 wherein said spooler includes an arbor for mounting said empty reel; and said conveyor comprises:

a chain adapted for movement along a continuous loop in a plane substantially perpendicular to said arbor, a portion of said loop constituting a major arc adjacent said dummy reel and being substantially congruent to said flange between said dummy reel and empty reel;

a sprocket for engaging said chain;

means for rotating said sprocket;

a chain guide for said chain portion and extending in a major arc of a circle being substantially congruent to said chain portion, said guide being adapted to guide said chain through said arc.

3. Apparatus according to claim 2 wherein said wire entry device is fixedly mounted to said chain and includes a shaft which projects over both said dummy reel and said aft flange of said winding reel when mounted to said arbor, said shaft being disposed at an angle to said arbor when said shaft is positioned directly above said arbor, said angle being sufficient to cause wire intercepted by said entry device to slide along said entry device towards said dummy reel.

4. Apparatus according to claim 2 wherein said wire exit device includes a shaft mounted to said chain so that at least a portion thereof extends at an angle downward and away from said chain when said exit device is positioned directly above said arbor, said angle being adapted to cause wire intercepted by said exit device to slide along the same towards said winding reel, said wire exit device being substantially co-extensive with said dummy reel along the axial dimension thereof.

5. Apparatus according to claim 1 wherein said dummy reel includes snagger means to engage wire, further comprising:

switch means mounted to said spooler proximate said conveyor;

switch striker means mounted to said conveyor for contacting said switch means during movement of said conveyor;

throw pin means, responsive to said switch means, mounted on said housing and adapted to engage and move said wire towards said snagger means when said switch means is contacted by said striker means;

shield means, movably mounted on said housing and positioned proximate said dummy reel, for shielding at least a portion of said fore flange from wire when wire is being wound onto said dummy reel.

6. Apparatus according to claim 5 wherein said shield means includes a member having an arcuate portion substantially aligned with a corresponding portion of the periphery of said dummy reel fore flange and positioned radially outwards of said flange, and moving means for moving said member axially with respect to said dummy reel at predetermined times.

7. A continuous wire spooler for winding wire onto reels having fore and aft flanges, said spooler comprising:

at least two rotatable arbors extending from said spooler, each of said arbors adapted to mount a winding reel thereto;

means for rotating each of said arbors;

a corresponding dummy reel for each of said arbors and mounted to said spooler proximate a flange of a winding reel when mounted to an arbor;

a rotatable snagging arrangement associated with each dummy reel for engaging and winding wire onto the associated dummy reel;

a wire distributor for repeatedly guiding onto a reel mounted to a first one of said arbors, then onto a reel mounted to a second one of said arbors;

a corresponding wire guide for each of said arbors, cooperating with said wire distributor, for intercepting and guiding wire passing from said distributor to a winding reel mounted to the corresponding arbor into position proximate the dummy reel corresponding to the other arbor and for transferring said wire from said dummy reel to the winding reel mounted on said other arbor, said wire guide including a conveyor adapted for movement at selected times in a path proximate said dummy reel; a wire-entry pin mounted to said conveyor and being adapted to intercept wire passing between said distributor and said dummy reel to move said wire onto said dummy reel; and a wire exit pin mounted to said conveyor means and adapted to intercept wire between said distributor and said dummy reel for moving said wire onto said winding reel for winding thereon.

8. A spooler in accordance with claim 7 further comprising a curtain and means mounting said curtain to said spooler for movement from a first position intermediate said arbors to a second position at which said curtain is withdrawn from between said arbors.

9. A spooler in accordance with claim 7 wherein said wire distributor includes means reciprocating between the axial extremes of said reels to guide wire therealong, said reciprocating means continuing to operate while said wire is being transferred between reels, so that wire does not accumulate at the ends of said reels.

10. A spooler in accordance with claim 7 further comprising corresponding transfer throw means for each of said arbors to engage wire moved by said wire-entry pin onto said dummy reel for urging said wire into the associated snagging arrangement.

11. A spooler in accordance with claim 10 further comprising means for severing wire extending between said dummy reel and the winding reel mounted on said other arbor after said wire is in said snagging arrangement.

12. A spooler in accordance with claim 11 further comprising a curtain, means mounting said curtain for movement from a first position intermediate said arbors to a second position at which said curtain is withdrawn from between said arbors, said curtain being in its second position prior to said wire being severed and being moved to said first position subsequent to said severing to permit safe removal of the winding reel mounted on said corresponding arbor.

* * * * *